US005159240A

United States Patent [19]

Chen et al.

[11] Patent Number: 5,159,240

[45] Date of Patent: Oct. 27, 1992

[54] LOW VOLTAGE LIMITING APERTURE ELECTRON GUN

[75] Inventors: Hsing-Yao Chen, Barrington, Ill.; Sen-Su Tsai, Taoyuan, Taiwan

[73] Assignee: Chunghwa Picture Tubes, Ltd., Taiwan

[21] Appl. No.: 805,378

[22] Filed: Dec. 9, 1991

[51] Int. Cl.[5] ..... H01J 29/46; H01J 29/56

[52] U.S. Cl. ..... 315/14; 313/414; 313/449

[58] Field of Search ..... 315/14, 15, 382, 382.1; 313/414, 449

[56] References Cited

U.S. PATENT DOCUMENTS

| | | | |
|---|---|---|---|
| 2,070,319 | 2/1937 | Rudenberg | 250/27.5 |
| 2,072,957 | 3/1937 | McGee | 250/27.5 |
| 2,111,941 | 3/1938 | Schlesinger | 250/27.5 |
| 2,128,581 | 8/1938 | Gardner | 250/27.5 |
| 2,135,941 | 11/1938 | Hirmann | 250/27.5 |
| 2,185,590 | 1/1940 | Epstein | 250/155 |
| 2,202,631 | 5/1940 | Headrick | 250/163 |
| 2,209,159 | 7/1940 | Gorlich et al. | 250/27.5 |
| 2,213,688 | 9/1940 | Broadway et al. | 250/160 |
| 2,217,168 | 10/1940 | Hefele et al. | 250/27 |
| 2,229,766 | 1/1941 | Nicoll et al. | 250/27 |
| 2,260,313 | 10/1941 | Gray | 250/27 |
| 2,888,606 | 5/1959 | Beam | 315/16 |
| 3,798,478 | 3/1974 | Say | 313/70 |
| 3,887,830 | 6/1975 | Spencer | 313/443 |
| 3,899,711 | 8/1975 | Lemmond | 313/414 |
| 3,919,588 | 11/1975 | Parks et al. | 315/14 |
| 3,928,784 | 12/1975 | Weijland | 313/389 |
| 4,009,410 | 2/1977 | Pommier et al. | 313/411 |
| 4,218,635 | 8/1980 | Bedard et al. | 315/17 |
| 4,268,777 | 5/1981 | van Roosmalen | 315/1 |
| 4,388,556 | 6/1983 | Rao | 315/14 |
| 4,467,243 | 8/1984 | Fukushima et al. | 313/448 |
| 4,540,916 | 9/1985 | Murayama et al. | 315/16 |
| 4,549,113 | 10/1985 | Rao | 315/14 |
| 4,628,224 | 12/1986 | Collins et al. | 313/414 |
| 4,724,359 | 2/1988 | Roussin | 315/15 |
| 4,764,704 | 8/1988 | New et al. | 313/414 |
| 4,886,998 | 12/1989 | Endo | 313/414 |
| 4,891,549 | 1/1990 | Kniesser et al. | 313/414 |
| 5,061,881 | 10/1991 | Suzuki et al. | 315/382 |
| 5,066,887 | 11/1991 | New | 313/414 |

*Primary Examiner*—Theodore M. Blum
*Attorney, Agent, or Firm*—Emrich & Dithmar

[57] ABSTRACT

A limiting aperture disposed in a low voltage, beam forming region (BFR) of an electron gun in a cathode ray tube (CRT) provides reduced electron beam spot size with low power dissipation. The limiting aperture is located in a low voltage, electrostatic field-free region, preferably in the screen grid electrode $G_2$, where the field-free region is formed by increasing the thickness of the screen grid electrode $G_2$ to 1.8 times the diameter of a pair of circular recessed portions in opposing surfaces of the screen grid electrode $G_2$ which are separated by the small diameter limiting aperture on the electron gun's axis through which the beam is directed. A narrow, relatively electrostatic field-free zone is thus formed in the center of the screen grid electrode $G_2$ which is maintained at a relatively low voltage, i.e., ranging from approximately 300 V to less than 12% of the anode voltage. The outer electrons in the relatively low energy electron beam are intercepted by the limiting aperture to provide a small, well defined beam spot size on the CRT screen.

29 Claims, 4 Drawing Sheets

TRAJECTORIES, BFR

TRAJECTORIES, MAIN LENS

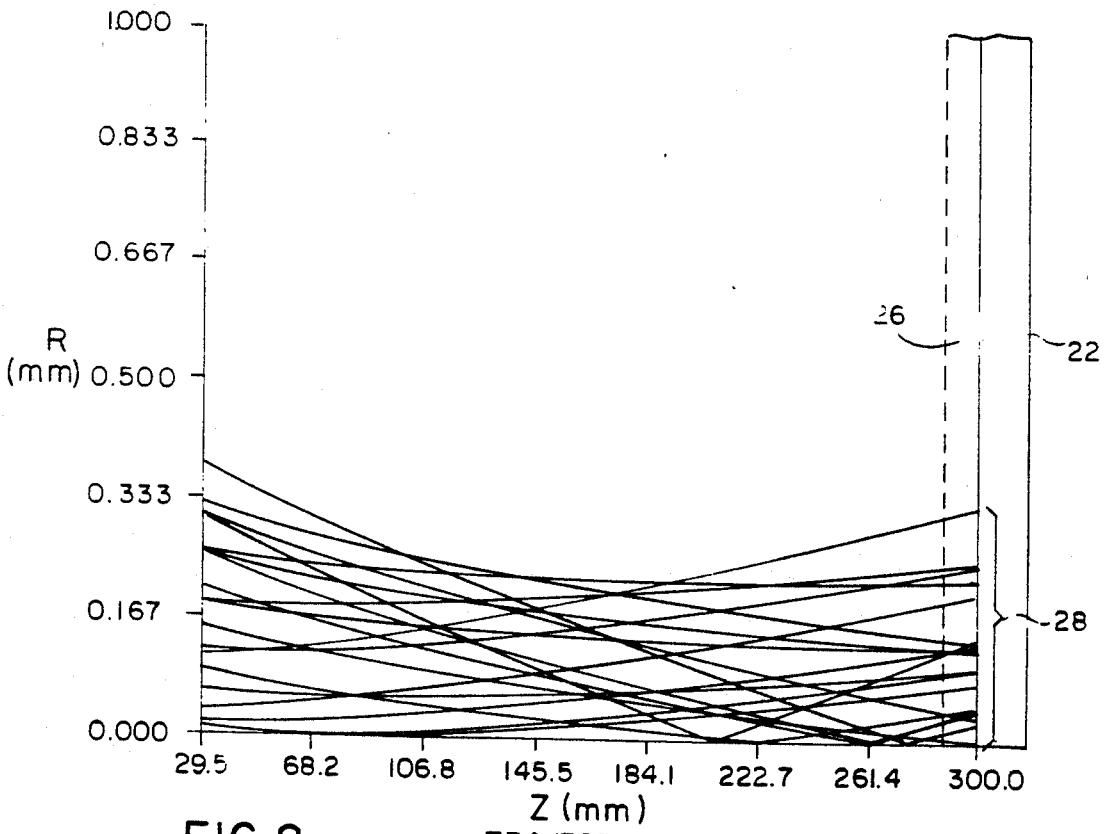
FIG. 8 TRAJECTORIES, TO SCREEN

LOW VOLTAGE LIMITING APERTURE ELECTRON GUN

FIELD OF THE INVENTION

This invention relates generally to electron guns for forming, accelerating and focusing an electron beam such as in a cathode ray tube (CRT) and is particularly directed to the beam forming region (BFR) of an electron focusing lens in a CRT and an arrangement for providing an electron beam with a small, well defined spot size.

BACKGROUND OF THE INVENTION

Electron guns employed in television CRTs generally can be divided into two basic sections: (1) a beam forming region (BFR), and (2) an electron beam focus lens for focusing the electron beam on the phosphor-bearing screen of the CRT. Most electron beam focus lens arrangements are of the electrostatic type and typically include discrete, conductive, tubular elements arranged coaxially and having designated voltages applied to each of the elements to establish an electrostatic focusing field. A monochrome CRT employs a single electron gun for generating and focusing a single electron beam. Color CRTs typically employ three electron guns with each gun directing a respective focused electron beam on the CRT -phosphorescing faceplate to provide the three primary colors of red, green and blue. The electron guns are frequently arranged in an inline array, or planar, although delta gun arrays are also quite common. The present invention has application in both monochrome and multi-electron beam color CRTs. A sharply focused electron beam having a small spot size provides a video image having high definition. In order to reduce beam spot size, limiting apertures of small size have been incorporated in the electron gun. These prior limiting aperture approaches have met with only limited success because of three sources of performance limitations.

In the conventional design, the limiting aperture is typically disposed in the focus voltage grid. In this region, the electrons typically have kinetic energies on the order of a few kilovolts (KV) which causes secondary electron emission at the focus grid. The secondary electrons generally land on the CRT screen causing loss of contrast and/or loss of purity in a color CRT. Because the electron beam typically has a large cross-section in the beam focus region, the focus grid limiting aperture is also relatively large. This increases the likelihood of the secondary electrons being incident on the screen. A second problem arises from the electrons intercepted by the limiting aperture flowing through the resistor chain toward the CRT's anode. This electron current causes focus voltage shift and a resulting de-focusing of the electron beam. The third problem also arises from the energetic electrons incident upon the focus voltage grid about the limiting aperture. Because the intercepted electrons in this high voltage region of the electron gun have high kinetic energy (the CRT gun typically has a focus voltage of a few thousand volts), the intercepted high energy electrons release their kinetic energy at the aperture region causing a substantial increase in the temperature of the focus voltage grid, which in some cases becomes vaporized before this energy can be dissipated. These three problems have limited prior art attempts to reduce electron beam spot size by means of a small aperture in the electron gun.

The present invention overcomes the aforementioned limitations of the prior art by providing a low voltage limiting aperture electron gun design which avoids electron beam aberration, minimizes secondary electron emissions, does not adversely affect electron beam focusing, and eliminates only low energy electrons from the beam to minimize grid thermal dissipation.

OBJECTS AND SUMMARY OF THE INVENTION

Accordingly, it is an object of the present invention to provide an electron beam in a CRT having a small, well defined spot size for improved video image quality Another object of the present invention is to provide an arrangement in the low voltage beam forming region of an electron gun which provides a small beam spot size with minimum energy dissipation in the form of heat and the elimination of secondary electron emissions and associated degradation of video image quality.

Yet another object of the present invention is to provide an electrostatic field-free region in the beam forming region of an electron focusing lens with a small aperture forming a barrier to the outer rays of an electron beam bundle in limiting beam spot size for improved video image definition and focusing.

A further object of the present invention is to provide an energy efficient, small aperture arrangement for limiting the spot size of an electron beam in an electron focusing lens without producing spherical aberration.

Another object of the present invention is to provide a very small limiting aperture to minimize the possibility of secondary electrons reaching the screen.

These objects of the present invention are achieved and the disadvantages of the prior art are overcome by a lens for focusing an electron beam comprised of energetic electrons emitted by a source along an axis toward a display screen, the lens comprising: a first low voltage focusing arrangement proximally disposed relative to the source on the axis for applying a first focusing electrostatic field to the energetic electrons for forming the energetic electrons into a beam, the first low voltage focusing arrangement including an electrostatic field-free region disposed on the axis; a second high voltage focusing arrangement disposed intermediate the first low voltage focusing arrangement and the display screen and on the axis for focusing the electron beam on the display screen; and a limiting aperture on the axis in the electrostatic field-free region of the first low voltage focusing arrangement for removing electrons in a peripheral portion of the electron beam in reducing electron beam spot size on the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 8 is a simplified schematic diagram illustrating the trajectories of electrons in the electron focusing lens as they are incident on a phosphor-coated display screen.

DESCRIPTION OF THE PREFERRED EMBODIMENT

There are primarily three characteristics of an electrostatic focusing lens which determine the diameter, or spot size, of the electron beam incident upon the phosphorescing display screen of a CRT. The goal, of course, is to provide sharply defined, precisely focused electron beams incident on the display screen. The three primary characteristics of the electrostatic focusing lens are its magnification, spherical aberration and space charge effect.

The magnification factor is given by the following expression:

$$d_M = d_o M = \frac{q}{p} \sqrt{\frac{V_o}{V_A}}\, d_o \quad (1)$$

where:

q=distance from the center of the main lens to display screen;

p=distance from the object plane to the center of the main lens;

$V_o$=voltage at the object side of the main lens;

$V_A$=voltage at the image side of the main lens; and $d_o$=object size.

The spherical aberration characteristic is given by the expression:

$$d_s = C_s \Theta \quad (2)$$

where:

$C_s$=coefficient of spherical aberration; and

Θ=electron beam's divergence angle.

Electron beam spot size growth occurs due to the fact that a point source focused by a lens cannot again be focused to a point. The further away an electron ray is from the focusing lens optical axis, the larger the lens focusing strength preventing the electron ray from again being focused to a point source.

The space charge effect on electron beam spot size is given by the expression:

$$d_{sp} \propto \Theta^{-1} \quad (3)$$

This growth factor in electron beam spot size arises from the repulsive force between like charged electrons.

Figure 1:
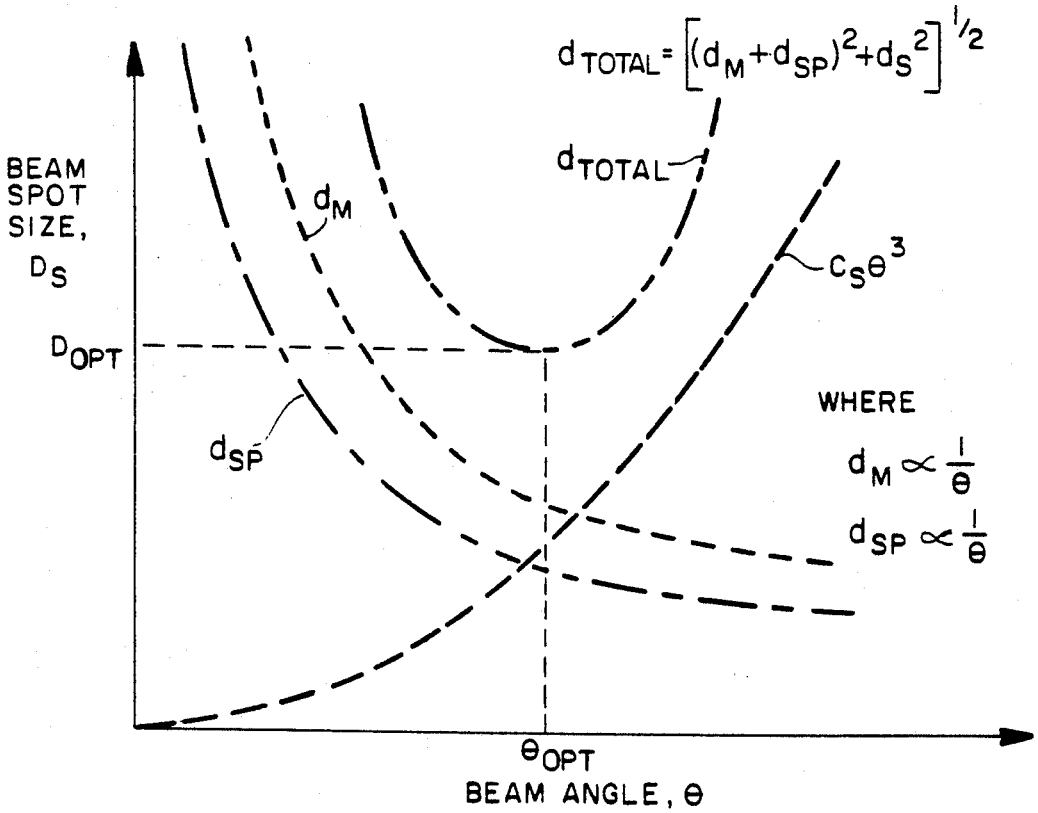
FIG. 1 shows the variation in electron beam spot size ($D_s$) with beam angle ($\Theta$), in terms of the three relevant factors of magnification ($d_m$), spherical aberration ($d_s$), and space charge effect ($C_s\Theta^3$)
Figure 2:
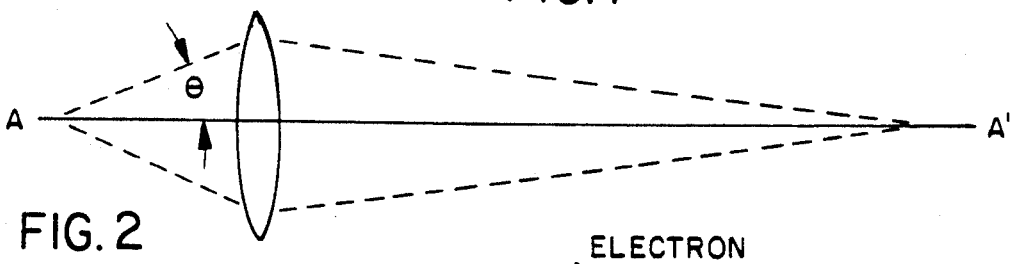
FIG. 2 is a simplified schematic diagram illustrating electron beam angle (Θ) relative to the beam axis A—A'.

FIG. 1 shows the variation in electron beam spot size ($D_s$) with beam angle (Θ), in terms of the three aforementioned factors of magnification ($d_M$), spherical aberration ($d_s$), and space charge effect ($d_{sp}$). With $d_{total}$ representing electron beam spot size with all three aforementioned factors included, it can be seen that $d_{total}$ is minimum at $\Theta_{opt}$ with $D_{opt}$. Beam angle Θ along the electron lens axis A—A' is shown in FIG. 2.

The electron beam is typically generated in a socalled beam forming region (BFR) of the electron gun. The BFR can be considered as an electron optical system separate from the electron gun's main lens for producing an electron beam bundle tailored to match the specific main lens of the electron gun. The outer rays of the electron beam bundle tend to be over-focused by the electron gun's main lens giving rise to a halo on the display screen about the focused beam spot. This halo degrades video image definition. The present invention eliminates this halo effect caused by the outer rays of an electron beam bundle for improved video image quality.

Figure 3:
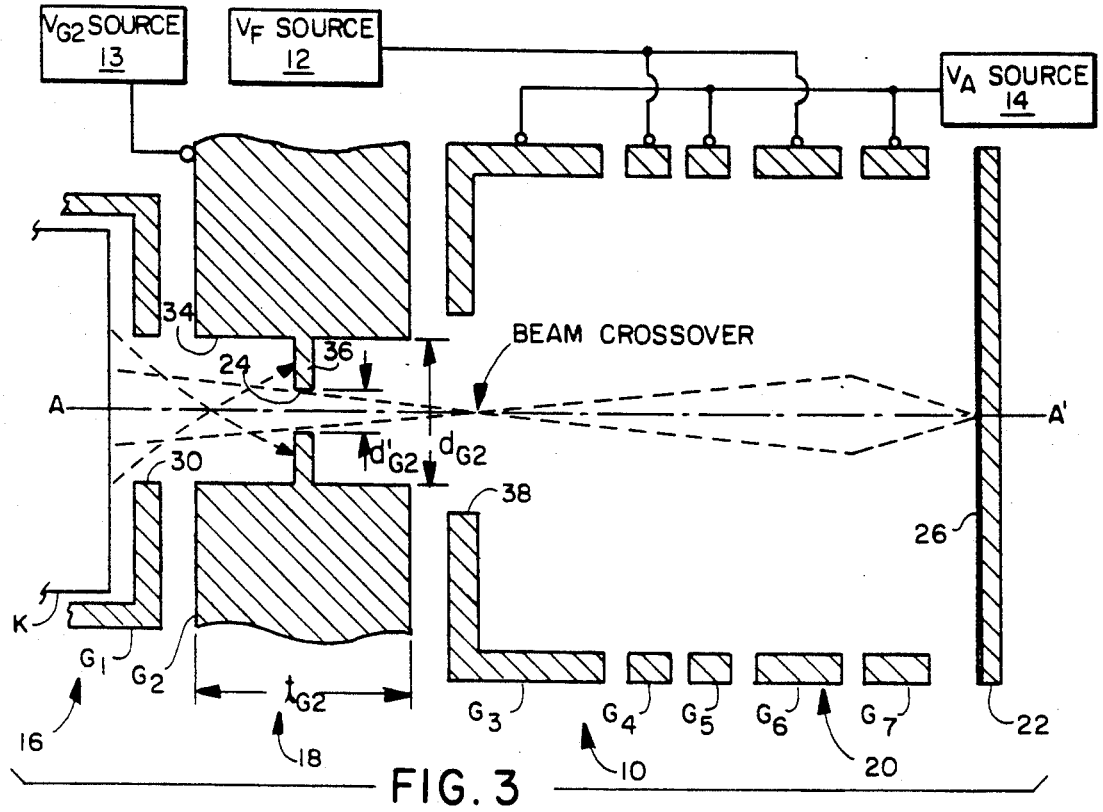
FIG. 3 is a simplified sectional view of a focusing lens for an electron gun incorporating a limiting aperture in the beam forming region thereof in accordance with the present invention.

Referring to FIG. 3, there is shown a simplified sectional view of an electron gun 10 incorporating a limiting aperture 24 in the low voltage beam forming region 18 thereof in accordance with the present invention. The electron gun 10 includes an electron beam source 16 which may be conventional in design and operation and typically includes a cathode K. Cathode K includes a sleeve, a heater coil and an emissive layer all of which are deleted from the figure for simplicity. Electrons are emitted from the emissive layer and are directed to the low voltage beam forming region 18 and are focused to a crossover along the axis of the beam A—A' by the effect of a grid commonly referred to as the $G_2$ grid. A control grid known as the $G_1$ grid disposed between cathode K and the $G_2$ grid is operated at a negative potential relative to the cathode and serves to control electron beam intensity in response to the application of a video signal thereto, or to cathode K. The electron beam's first crossover is at a point where the electrons pass through the axis A—A' and is typically in the vicinity of the $G_2$ grid. The terms "voltage" and "potential" are used interchangeably in the following paragraphs as are the terms "grid" and "electrode".

Electron gun 10 further includes a $G_3$ grid, a $G_5$ grid, and a $G_7$ grid, each of which is coupled to and charged by an accelerating anode voltage ($V_A$) source 14. Electron gun 10 further includes a $G_4$ grid and a $G_6$ grid, each of which is coupled to and charged by a focus voltage ($V_F$) source 12. The accelerating voltage $V_A$ is substantially higher than the focus voltage $V_F$ and serves to accelerate the electrons toward a display screen 18 having a phosphor coating 26 on the inner surface thereof. $V_F$ is typically 20%-40% of the anode voltage $V_A$.

Each of the grids is aligned with the electron beam axis A—A' and is coaxially disposed about the axis. Grids $G_1$, $G_2$ and $G_3$ are each provided with respective apertures 30, 24 and 38 through which the energetic electrons pass as they are directed toward the display screen 22.

In accordance with the present invention, the $G_2$ grid is provided with a limiting aperture 24 and an increased thickness. Limiting aperture 24 is generally circular and has a diameter of $d_{G2}'$. As indicated above, $V_{G1}$ is a negative potential relative to the cathode for controlling the intensity of the electron beam in response to the application of a video signal to cathode K. In a preferred embodiment, $300V \leqq V_{G2} \leqq 0.12\ V_A$, where $V_{G2}$ is the potential applied to the $G_2$ grid. The $G_1$ grid generally serves to control electrons emitted from cathode K and direct them in the general direction of the display screen 22. The $G_2$ grid serves to form the first crossover of the electron beam, to control electron beam intensity, and to minimize electron beam spot size at the display screen 22.

The $G_2$ grid further includes first and second outer recesses 32 and 34 disposed on opposed surfaces thereof and aligned along axis A—A'. The first and second outer recesses 32, 34 each have a diameter of $d_{G2}$. Disposed intermediate the first and second outer recesses 32, 34 is an inner partition 36 containing limiting aperture 24. In a preferred embodiment, the diameter $d_G'$ of the limiting aperture 24 is 10–50% of the diameter $d_{G2}$ of the first and second outer recesses 32, 34, or $0.1\ d_{G2} \leqq d_{G2}' \leqq 0.5\ d_{G2}$. The first and second outer recesses 32, 34 define respective facing recessed portions in the $G_2$ grid which cause the electrostatic field to be reduced essentially to zero within the grid along axis A—A' while limiting aperture 24 limits electron beam spot size as described in the following paragraphs. In a preferred embodiment, $t_{G2} \geqq 1.8\ d_{G2}$, with $t_{G2} \geqq 0.54$–$1.44$ mm and $d_{G2}$0.3–0.8 mm.

As shown in FIG. 3, the $G_2$ grid is coupled to a $V_{G2}$ voltage source 13 which maintains it at a voltage of $V_{G2}$. The present invention allows for a separate power supply, or voltage source, 13 for the $G_2$ grid from the $V_F$ and $V_A$ sources 12, 14 which ensures that the intercepted beam current does not affect electron beam focusing and/or the beam cut-off characteristics of the beam forming region 18.

Figure 4:
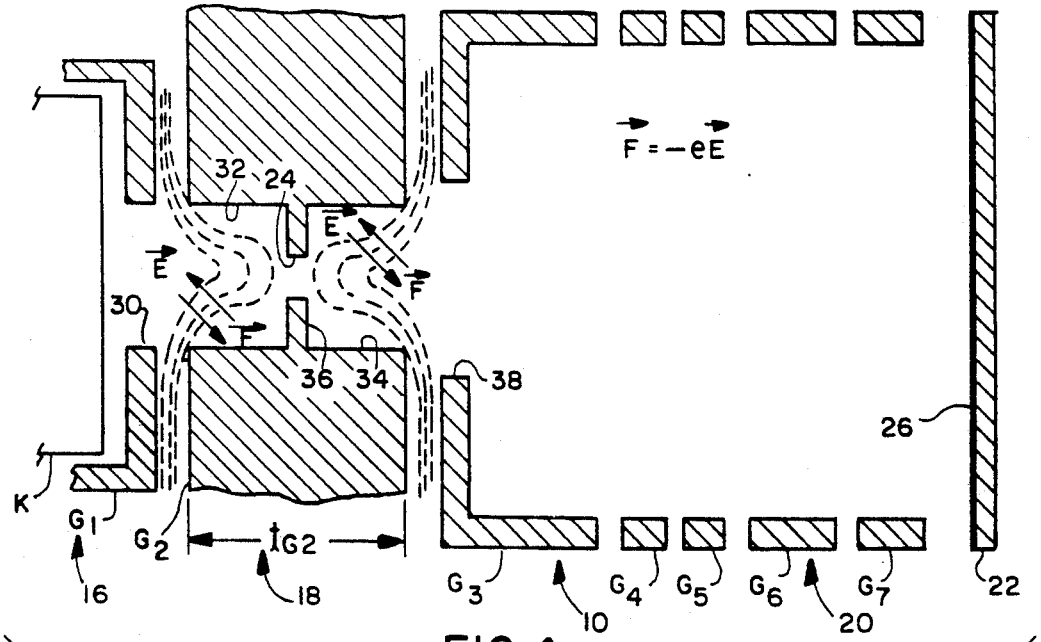
FIG. 4 is a sectional view of the electron beam focusing lens of FIG. 2 illustrating the electrostatic fields and forces applied to the electrons in the beam forming region in according with the present invention.

Referring to FIG. 4, there is shown the sectional view of the electron gun of FIG. 3 illustrating the electrostatic fields and forces applied to the electrons in the beam forming region 18 of the electron gun in accordancw with the present invention. Equipotential lines are shown in dottedline form adjacent the $G_2$ grid, and in particular adjacent the limiting apeture 24 in the $G_2$ grid. From the figure, it can be seen that the recessed portions of the $G_2$ grid formed by first and second outer recesses 32, 34 adjacent the limiting aperture 24 form equipotential lines which bend inwardly toward the limiting aperture. Because the thickness of the $G_2$ grid is such that $t_{G2} \geqq 1.8\ d_{G2}$, the equipotential lines are essentially zero in the immediate vicinity of limiting aperture 24. The electrostatic field, represented by the field vector $\vec{E}$, applies a force represented by the force vector $\vec{F}$ to an electron, where $\vec{F} = -e\ \vec{E}$, where "e" in the charge of an electron. An electrostatic field is formed between two charged electrodes, where $G_1$ is operated at a negative potential relative to the cathode, while the $G_2$ voltage is preferably set between 300V and $0.12\ V_A$, and $G_3$ is preferably maintained at the focus voltage $V_F$. A portion of the outer periphery of the electron beam strikes the inner portion of the $G_2$ grid defining the limiting aperture 24 to cut off the outer periphery of the electron beam. This limits beam spot size as the electron beam transmits the $G_2$ grid and proceeds toward the $G_3$ grid. The low voltage side of the $G_2$ grid thus operates as a diverging lens, while the high voltage side of the $G_2$ grid adjacent the $G_3$ grid functions as a converging lens to effect electron beam crossover.

Figure 5:
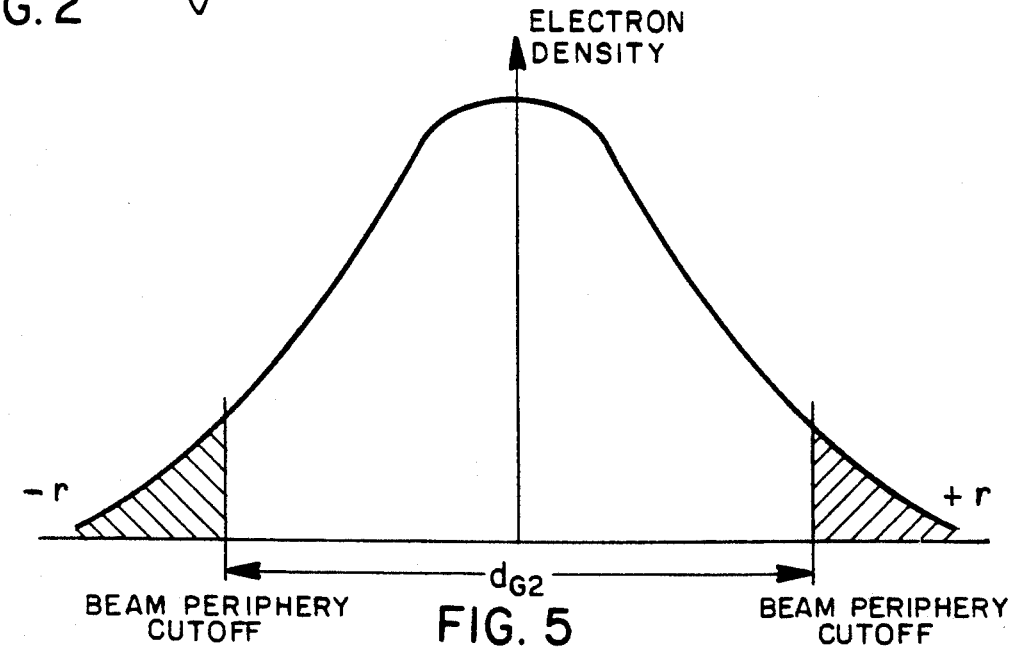
FIG. 5 is a graphic illustration of the Gaussian distribution of electrons in an electron beam and the manner in which the limiting aperture of the present invention removes outer electrons from the beam to provide a small electron beam spot size.

Referring to FIG. 5, there is shown a graphic illustration of the Gaussian distribution of electrons in an electron beam and the cut-off of outer electron rays by the limiting aperture 24 of the present invention to form a small electron beam spot size. Because the limting aperture 24 of the $G_2$ grid is disposed in a field-free region, the limiting aperture does not have a lens effect on the electron beam and does not produce undesirable spherical aberration. Where a limiting aperture is disposed in an electrostatic field region, the electrons are affected by electrostatic field gradients resulting in spherical aberration of the electron beam spot on the inner surface of the display screen. Because limiting aperture 24 is in a field-free region, the portion of the $G_2$ grid defining the limiting aperture does not electrostatically interact with the electrons, but merely presents a physical barrier to electron rays about the periphery of the electron beam. As shown in FIG. 5, electron rays disposed beyond, or outside of, limiting aperture with a diameter of $d_{G2}$ are eliminated from the electron beam.

Figure 6:
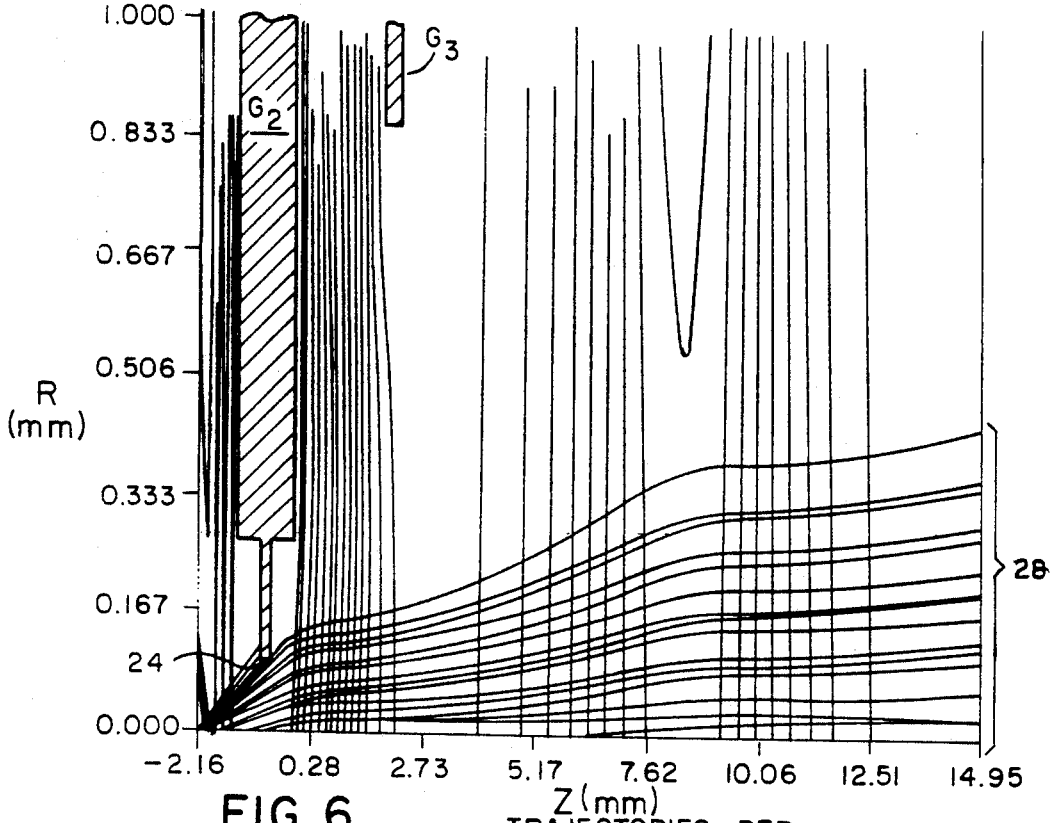
FIG. 6 is a simplified schematic diagram of a portion of the electron gun shown in FIGS. 3 and 4 illustrating various trajectories of electron is in the electron beam in the beam forming and high voltage focusing portions of the electron gun.

Referring to FIG. 6, there is shown the trajectories of electrons in the form of electron rays 28 transiting the $G_2$ and $G_3$ portions of the electron gun. In FIG. 6, R represents the distance from the axis of the electron beam which is coincident with the horizontal axis in the figure. Z represents the distance along the electron beam axis, while the generally vertical lines in the figure represent equipotential lines having the values generally indicated in the figure. As shown in the figure, some electron rays 28 are incident upon the $G_1$ side of the $G_2$ grid and are absorbed and are thus removed from the electron beam by the limiting aperture 24. These rejected electron rays represent off-axis electrons which are eliminated from the beam to provide a small beam spot size. In the region of the $G_3$ grid, the electron rays 28 are bent generally toward the beam axis by the electrostatic field produced by the $G_3$ grid and the $G_4$ main lens.

Figure 7:
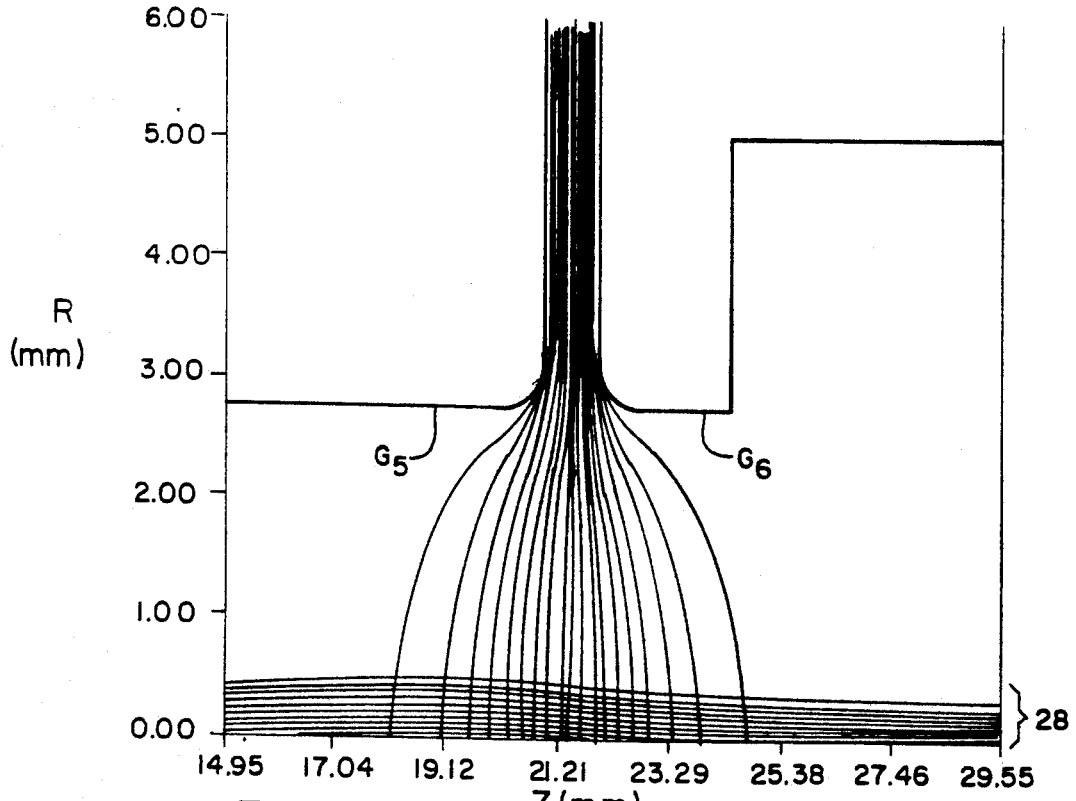
FIG. 7 is a simplified schematic diagram illustrating the influence of the electrostatic focusing field on the electron beam in high voltage focusing portion of the electron gun.

Referring to FIG. 7, there is shown the electrostatic field formed by the $G_4$ and $G_5$ grids and its effect on the electron rays 28. As shown in the figure, the equipotential lines are oriented generally transverse to the direction of electron trajectories in the vicinity of the $G_4$ and $G_5$ grids. The electrostatic field produced by the $G_4$ and $G_5$ grids directs the electrons toward the beam axis as the electrons approach the display screen.

Referring to FIG. 8, there is shown the electron rays 28 representing the trajectories of electrons as they ar incident upon the phosphor coating 26 of the display screen 22. As shown in the figure, the electron rays 28 are directed generally toward the electron beam axis to provide small beam spot size on the display screen 22.

There has thus been shown a limiting aperture disposed in a low voltage, beam forming region o- an electron gun in a CRT for providing small electron beam spot size on the CRT display screen. The limiting aperture is preferably located in the screen grid electrode $G_2$, where a field-free region is formed by increasing the $G_2$ grid thickness to a value greater than twice the size of the diameter of the $G_2$ aperture. With the $G_2$ grid maintained at a potential between 300V and $0.12\ V_A$ (accelerating anode voltage), the field at the center of the $G_2$ grid on the electron beam axis is essentially zero and the inner portion of the $G_2$ grid defining the limiting aperture cuts-off outer electron beam rays to provide a small beam spot size.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A lens for focusing an electron beam comprised of energetic electrons emitted by a source along an axis and focused by a main lens then accelerated by an anode voltage $V_A$ toward a display screen, said lens comprising:

first low voltage focusing means proximally disposed relative to said source on said axis for applying a first focusing electrostatic field to the energetic electrons for forming the energetic electrons into a beam, said first low voltage focusing means including a charged grid having a thickness t along said axis and means for providing a relatively electrostatic field-free region on said axis;

second high voltage focusing means disposed intermediate said first low voltage focusing means and said main lens and on said axis for focusing the electron beam on the display screen; and means defining a limiting aperture within said charged grid and on said axis in the relatively electrostatic field-free region of aid first low voltage focusing means for removing electrons in a peripheral portion of the electron beam in reducing electron beam spot size on the display screen, wherein said limiting aperture is generally circular having a diameter d', where $t > d'$.

2. The lens of claim 1 wherein said charged grid comprises a $G_2$ grid.

3. The lens of claim 2 wherein said $G_2$ grid includes first and second recessed portions extending inwardly from opposed facing surfaces of aid $G_2$ grid aligned along said axis and said $G_2$ grid further includes a thin wall separating said first and second recessed portions and including said means defining said limiting aperture.

4. The lens of claim 3 wherein each of said first and second recessed portions is generally circular having a diameter d, where $t \geqq 1.8d$.

5. The lens of claim 4 wherein $t \geqq 0.54$–$1.44$ mm and $d = 0.3 - 0.8$ mm.

6. The lens of claim 4 wherein $d' = 10$–$50\%$ d.

7. The lens of claim 6 wherein said $G_2$ grid is maintained at a potential of $G_2$, where $300V \leqq V_{G2} > 0.12$ $V_A$, where $V_A$ is the anode voltage.

8. The lens of claim 7 wherein the source of electrons includes a cathode K and said lens further includes a charged $G_1$ grid disposed intermediate said cathode K and said $G_2$ grid.

9. The lens of claim 8 further comprising a charged $G_3$ grid disposed adjacent to said $G_2$ grid and intermediate said $G_2$ grid and said display screen and including an aperture therein disposed on said axis through which the electron beam passes.

10. The lens of claim 9 wherein said $G_1$ and $G_2$ grids form an electron beam crossover on said axis and wherein said $G_3$ grid is disposed adjacent said beam crossover.

11. The lens of claim 1 further comprising a first lower voltage power supply coupled to said charged grid and a second higher voltage power supply coupled to said second high voltage focusing means.

12. An electron gun for a cathode ray tube, comprising:

cathode means for generating energetic electrons;

low voltage beam forming means disposed adjacent said cathode means for receiving said energetic electrons and forming an electron beam with a beam crossover on a longitudinal axis of the electron gun, said beam forming means including a charged grid having a thickness t along said axis and further including a relatively field-free region therein;

high voltage focusing means for receiving said electron beam at said beam crossover and for focusing said electron beam on a display screen; and means disposed on the longitudinal axis o the electron gun in the relatively field-free region of said beam forming means for defining a generally circular beam limiting aperture in said charged grid having a diameter d' for removing electrons disposed about the periphery of said electron beam in reducing electron beam cross-section and electron beam spot size on said display screen, wherein $t > d'$.

13. The electron gun of claim 12 wherein said charged grid comprises a $G_2$ grid.

14. The electron gun of claim 13 wherein said $G_2$ grid includes first and second recessed portions extending inwardly from opposed facing surfaces of said $G_2$ grid aligned along said axis and said $G_2$ grid further includes a thin wall separating said first and second recessed portions and including said means defining said limiting aperture.

15. The electron gun of claim 14 wherein each of said first and second recessed portions is generally circular having a diameter d, where $t \geqq 1.8d$.

16. The electron gun of claim 15 wherein $t \leqq 0.54$–$1.44$ mm and $d = 0.3$–$0.8$ mm.

17. The electron gun of claim 15 wherein $d' = 10$–$50\%$ d.

18. The electron gun of claim 17 wherein said $G_2$ grid is maintained at a potential of $V_{G2}$, where $300V \leqq V_{G2} < 12\%$ of an anode voltage $V_A$.

19. The electron gun of claim 18 wherein the source of electrons includes a cathode K and said lens further includes a charged $G_1$ grid disposed intermediate said cathode K and said $G_2$ grid.

20. The electron gun of claim 19 further comprising a charged $G_3$ grid disposed adjacent to said $G_2$ grid and intermediate said $G_2$ grid and said display screen and including an aperture therein disposed on said axis through which the electron beam passes.

21. The electron gun of claim 20 wherein said $G_1$ and $G_2$ grids form an electron beam crossover on said axis and wherein said $G_3$ grid is disposed adjacent said beam crossover.

22. The electron gun of claim 12 further comprising a first lower voltage power supply coupled to said charged grid and a second higher voltage power supply coupled to said high voltage focusing means.

23. A lens for focusing an electron beam comprised of energetic electrons emitted by a source along an axis and accelerated by an anode voltage $V_A$ toward a display screen, said lens comprising:

first low voltage focusing means proximally disposed relative to said source on said axis for applying a first focusing electrostatic field to the energetic electrons for forming the energetic electrons into a beam, said first low voltage focusing means including means for providing a relatively electrostatic field-free region on said axis, said first low voltage focusing means further including a charged grid having a thickness t along said axis and first and second recessed portions extending inwardly from opposed facing surfaces of said grid aligned along said axis, wherein each of said recessed portions has a diameter d and $t \geqq 1.8$ d;

second high voltage focusing means disposed intermediate said first low voltage focusing means and said display screen and on said axis for focusing the electron beam on the display screen; and means defining a limiting aperture on said axis in the relatively electrostatic field-free region of said first low voltage focusing means for removing electrons in a peripheral portion of the electron beam in reducing electron beam spot size on the display screen, wherein said limiting aperture has a diameter d', where d' = 10–50% d.

24. An electron gun for a cathode ray tube, comprising:

cathode means for generating energetic electrons;

low voltage beam forming means disposed adjacent said cathode means for receiving said energetic electrons and forming an electron beam with a beam crossover on a longitudinal axis of the electron gun, said beam forming means including a relatively field-free region therein;

high voltage focusing means for receiving said electron beam at said beam crossover and for focusing said electron beam on a display screen; and means disposed on the longitudinal axis of the electron gun in the relatively field-free region of said beam forming means for removing electrons disposed about the periphery of said electron beam in reducing electron beam cross-section and electron beam spot size on said display screen, wherein said means for removing electrons includes a charged grid having a thickness t along said axis and including first and second recessed portions extending inwardly from opposed facing surfaces of said charged grid along said axis, each of said recessed portions having a diameter d, said means for removing electrons further including a limiting aperture having a diameter d' through which the electron beam passes disposed on said axis intermediate said first and second recessed portions, where d' = 10–50% d, and $t \leqq 1.8$d.

25. An electron gun for directing and focusing an electron beam on a display screen, said electron gun comprising:

a source of energetic electrons;

low voltage electrostatic beam forming means for receiving and forming said energetic electrons into a beam and directing said electron beam to a beam crossover on an axis of the electron gun, said electrostatic beam forming means including a charged grid having first and second recessed portions on opposed surfaces therein forming a relatively field-free region and a limiting aperture disposed intermediate said first first and second recessed portions and in said field-free region with said energetic electrons directed through said recessed portions and said limiting aperture to said beam crossover, wherein a first diverging electrostatic field is applied to said electron beam as it transits aid first recessed portion of said beam forming means followed by the application of a converging electrostatic field to said electron beam as it transits said second recessed portion of said beam forming means, and wherein said limiting aperture removes peripheral electrons from said electron beam in reducing electron beam spot size wherein said limiting aperture is generally circular having a diameter d', the charged grid has a thickness t along said axis, where t > d'and high voltage electrostatic focusing means disposed adjacent said beam crossover for focusing said electron beam on the display screen.

26. The electron gun of claim 25 wherein said charged grid has a thickness $t_G$ and includes first and second generally circular recessed portions each having a diameter $d_G$ and extending inwardly from opposed facing surfaces of said charged grid along said axis, where $t_G \geqq 1.8\ d_G$.

27. The electron gun of claim 26 wherein $t_G \geqq 0.54$–1.44 mm and $d_G = 0.3$–0.8 mm.

28. The electron gu of claim 27 further comprising means for applying an anode voltage $V_A$ for accelerating said electrons toward the display screen, where said charged grid is maintained at a voltage $V_G$, and wherein $300\ V \leqq V_G 12\%\ V_A$.

29. The electron gun of claim 25 further comprising a first lower voltage power supply coupled to said charged grid and a second higher voltage power supply coupled to said high voltage electrostatic focusing means.

* * * * *

UNITED STATES PATENT AND TRADEMARK OFFICE

CERTIFICATE OF CORRECTION

PATENT NO. :5,159,240

DATED :October 27, 1992

INVENTOR(S) :Hsing-Yao Chen et al.

It is certified that error appears in the above-identified patent and that said Letters Patent is hereby corrected as shown below:

| COLUMN | LINE | DESCRIPTION |
|---|---|---|
| 2 | 16 | After "quality", insert --.-- |
| 2 | 69 | "$(d_s)$" should be --$(d_{sp})$-- |
| 3 | 60 | "$C_s\theta$" should be --$C_s\theta^3$-- |
| 5 | 24 | "$d_G$'" should be --$d_{G2}$'-- |
| 5 | 34 | "$d_{G2}$0.3-0.8" should be --$d_{G2}$ = 0.3 - 0.8 mm-- |
| 5 | 46-47 | "accordancw" should be --accordance-- |
| 6 | 1 | "transmits" should be --transits-- |
| 6 | 53 | "ar" should be --are-- |
| 6 | 59 | "o-" should be --of-- |
| 7 | 37 | "aid" should be --said-- |
| 7 | 47 | "aid" should be --said-- |
| 7 | 58 | "$G_2$" should be --$V_{G2}$-- |
| 7 | 58 | ">" should be --<-- |

UNITED STATES PATENT AND TRADEMARK OFFICE

CERTIFICATE OF CORRECTION

PATENT NO. : 5,159,240

DATED : October 27, 1992

INVENTOR(S) : Hsing-Yao Chen et al.

It is certified that error appears in the above-identified patent and that said Letters Patent is hereby corrected as shown below:

IN THE CLAIMS

| COLUMN | LINE | DESCRIPTION |
|---|---|---|
| 8 | 23 | "o" should be --of-- |
| 8 | 44 | "≤" should be --≥-- |
| 10 | 3 | "≤" should be --≥-- |
| 10 | 21 | "aid" should be --said-- |
| 10 | 32 | After "d'", insert --;-- |
| 10 | 32 | After "and", a new paragraph should start |
| 10 | 44 | "gu" should be --gun-- |
| 10 | 48 | "$V_G$12%" should be --$V_G$ < 12%-- |

Signed and Sealed this

Nineteenth Day of October, 1993

Bruce Lehman

*Attest:*

BRUCE LEHMAN

*Attesting Officer*

*Commissioner of Patents and Trademarks*